US006516523B1

(12) United States Patent
Lin

(10) Patent No.: US 6,516,523 B1
(45) Date of Patent: Feb. 11, 2003

(54) PUNCH

(76) Inventor: Joe Lin, 4114 King Cotton La., Missouri City, TX (US) 77459

( * ) Notice: Subject to any disclaimer, the term of this patent is extended or adjusted under 35 U.S.C. 154(b) by 43 days.

(21) Appl. No.: 09/723,120

(22) Filed: Nov. 27, 2000

(51) Int. Cl.[7] ..... B26F 1/00

(52) U.S. Cl. ..... 30/363; 30/366; 30/189; 81/383.5; 72/409.1

(58) Field of Search ..... 30/363, 366, 250, 30/189, 217, 218, 290, 301, 316; 81/383.5, 371, 319, 320; 72/409.01, 409.1

(56) References Cited

U.S. PATENT DOCUMENTS

| | | | | | |
|---|---|---|---|---|---|
| 566,402 | A | * | 8/1896 | Keighley | 30/363 |
| 669,231 | A | * | 3/1901 | Carmody | 144/196 |
| 732,850 | A | | 7/1903 | Hayden | |
| 750,024 | A | | 1/1904 | Etnyre et al. | |
| 902,643 | A | * | 11/1908 | Blum | 30/363 |
| 938,580 | A | * | 11/1909 | Harling | 30/363 |
| 1,065,752 | A | | 6/1913 | Whitney | |
| 1,563,671 | A | | 12/1925 | Spengler | |
| 2,330,009 | A | * | 9/1943 | Romanoff | 30/189 |
| 2,394,385 | A | * | 2/1946 | Hueber et al. | 30/363 |
| 3,015,161 | A | | 1/1962 | Semler | |
| 3,601,880 | A | | 8/1971 | Brown | |
| 3,842,650 | A | | 10/1974 | Hartmeister | |
| 4,033,037 | A | | 7/1977 | Cooley | |
| 4,707,924 | A | | 11/1987 | Burney | |
| 4,729,170 | A | | 3/1988 | Hartmeister | |
| 4,753,010 | A | | 6/1988 | Franovich | |
| 4,922,615 | A | | 5/1990 | Nishida | |
| 5,022,253 | A | | 6/1991 | Parlatore | |
| 5,377,415 | A | | 1/1995 | Gibson | |

* cited by examiner

*Primary Examiner*—Boyer D. Ashley
(74) *Attorney, Agent, or Firm*—John R Casperson

(57) ABSTRACT

A punch for making holes in sheet stock is disclosed having three main components, a frame, a lever arm, and a plunger. The frame defines a tool head with a handle extending therefrom. The tool head defines a lower jaw and an upper jaw. The upper jaw is spaced apart from the lower jaw to define a first slot opening into the tool head from the first lateral side between the upper jaw and the lower jaw. The stock to be punched can be received and positioned by the slot. A plunger is mounted in the lower jaw for sliding movement toward the upper jaw. A lever arm extends into the tool head and actuates the plunger around a pivot point in the tool head upon being urged toward the handle.

13 Claims, 4 Drawing Sheets

PUNCH

BACKGROUND OF THE INVENTION

The invention relates to a punch capable of punching holes in sheet stock of various materials.

Many different types of manual punches are known to the art. However, there exists a continuing need for manual punches which are capable of exerting great force and are lightweight and simple in construction.

It is an object of this invention to provide such a punch.

SUMMARY OF THE INVENTION

A punch tool according to one embodiment of the invention comprises just three main components, a frame, a lever arm, and a plunger.

The frame defines a tool head with a handle extending therefrom. The tool head has a front face and a back face, an upper end and a lower end, a first lateral side and a second lateral side. The tool head defines a lower jaw and an upper jaw. The upper jaw is spaced apart from the lower jaw to define a first slot opening into the tool head from the first lateral side between the upper jaw and the lower jaw. The stock to be punched can be received and positioned by the slot.

The lower jaw defines a first vertical borehole which extends alongside the first lateral side of the tool head. The first vertical borehole has a longitudinal axis and opens toward the upper jaw.

The upper jaw defines a second vertical borehole which extends alongside the first lateral side. The second vertical borehole has a longitudinal axis and opens toward the lower jaw. The second vertical borehole is in alignment with the first vertical borehole.

The tool head further defines a second slot which is vertically elongated and forms a passage from the first vertical borehole to the second lateral side of the tool head. A first transverse aperture in the tool head forms a passage extending from the front face of the tool head to the second slot. A second transverse aperture in the tool head forms a passage extending from the back face of the tool head to the second slot. The second transverse aperture is in alignment with the first transverse aperture.

The handle extends from the lower end of the tool head.

A plunger having a first end and a second end is slidably mounted in the first vertical borehole. The plunger has a downwardly facing cam face between its first end and its second end.

A lever arm is positioned in the second slot and actuates the plunger. The lever arm has a cam end, a cam end portion extending from the cam end, a handle end, a handle end portion extending from the handle end, and a pivot portion which connects the cam end portion and the handle portion. A transverse aperture in the pivot portion is provided for receiving a pivot pin.

The lever arm is mounted to the tool head by a pivot pin which extends through the transverse aperture in the lever arm, the first transverse aperture in the tool head, and the second transverse aperture in the tool head. The pivot pin pivotally mounts the lever arm to the tool head with the cam end portion of the lever arm being positioned in the second slot so that the cam end of the lever arm cammingly contacts the downwardly facing cam face of the plunger.

By urging the lever arm toward the handle, the plunger is urged upwardly toward the upper jaw to punch a hole in stock which is positioned in the first slot.

DETAILED DESCRIPTION OF THE INVENTION

A tool 2 according to one embodiment of the invention comprises a frame 4, a lever arm 6, and a plunger 8.

Figure 3:
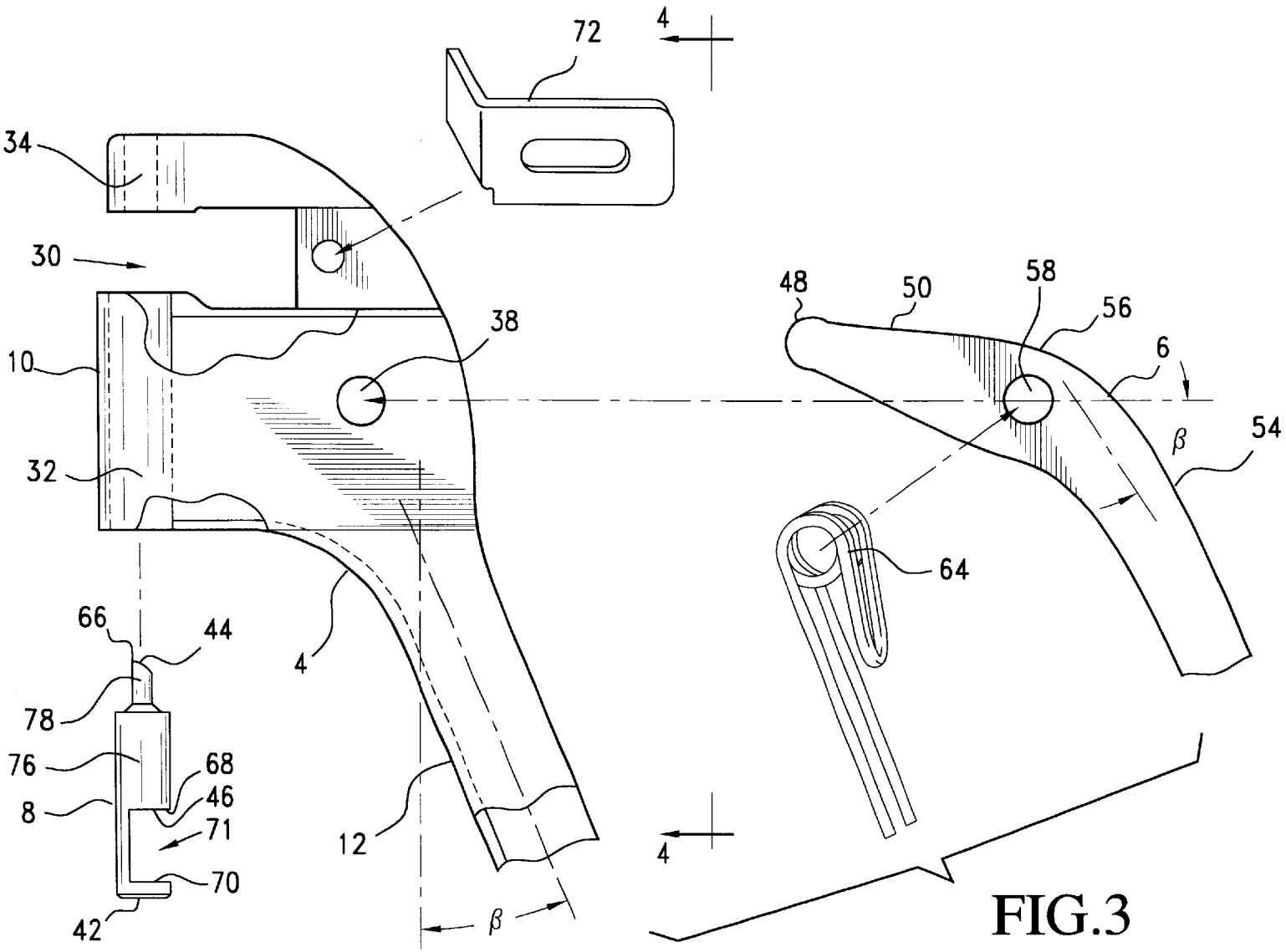
FIG. 3 is an exploded view of a portion of the tool illustrated in FIGS. 1 and 2 to better show internal features. Portions of the housing have been broken away for the purposes of illustration.
Figure 4:
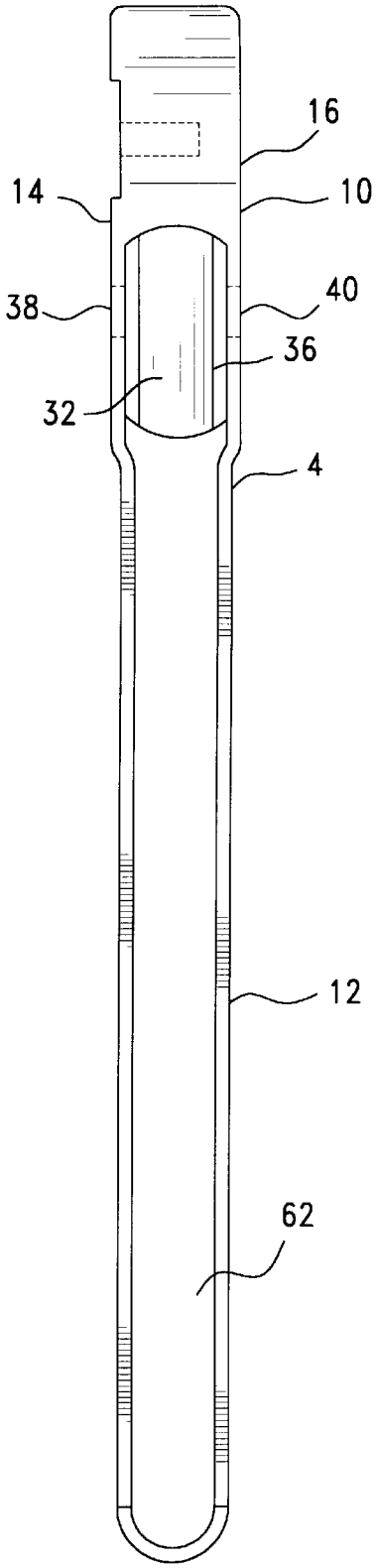
FIG. 4 is a side view of a portion of the tool shown in FIG. 3 taken along lines 4—4.

The frame defines a tool head 10 with a handle 12 extending therefrom. The tool head has a front face 14 and a back face 16 (see FIG. 4), an upper end 18 and a lower end 20 (See FIG. 2), a first lateral side 22 and a second lateral side 24. The tool head defines a lower jaw 26 and an upper jaw 28. The upper jaw is spaced apart from the lower jaw to define a first slot 30 (See FIG. 3) opening into the tool head from the first lateral side between the upper jaw and the lower jaw.

The lower jaw defines a first vertical borehole 32 (See FIG. 3) which extends alongside the first lateral side of the tool head. The first vertical borehole has a longitudinal axis and opens toward the upper jaw.

The upper jaw defines a second vertical borehole 34 which extends alongside the first lateral side. The second vertical borehole has a longitudinal axis and opens toward the lower jaw. The second vertical borehole is in alignment with the first vertical borehole.

The tool head further defines a second slot 36 (See FIG. 4) which is vertically elongated and forms a passage from the first vertical borehole to the second lateral side of the tool head. A first transverse aperture 38 in the tool head forms a passage extending from the front face of the tool head to the second slot. A second transverse aperture 40 in the tool head forms a passage extending from the back face of the tool head to the second slot. The second transverse aperture is in alignment with the first transverse aperture.

The handle extends from the lower end of the tool head.

Figure 2:
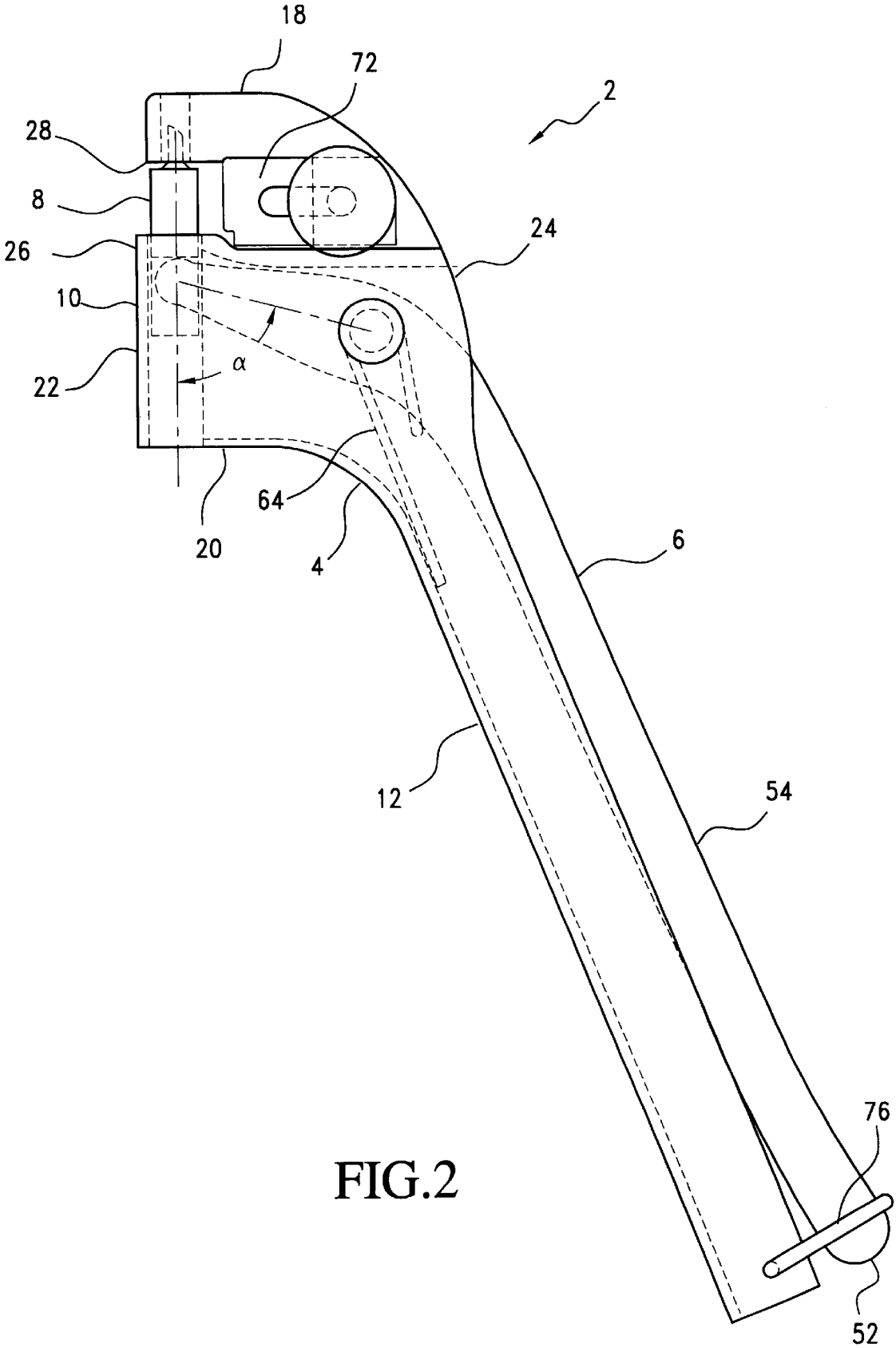
FIG. 2 is a plan view of a tool as shown in FIG. 1, but in an actuated configuration. Dashed lines illustrate internal surfaces of the tool.

The plunger 8 has a first end 42 and a second end 44 and is slidably mounted in the first vertical borehole (See FIG. 2). The plunger has a downwardly facing cam face 46 between its first end and its second end.

The lever arm 6 is positioned in the second slot 36 and actuates the plunger. The lever arm has a cam end 48 (See FIG. 3), a cam end portion 50 extending from the cam end, a handle end 52 (See FIG. 2), a handle end portion 54 extending from the handle end, and a pivot portion 56 (See FIG. 3) which connects the cam end portion and the handle portion. A transverse aperture 58 in the pivot portion is provided for receiving a pivot pin.

The lever arm is mounted to the tool head by a pivot pin 60 (See FIG. 1) which extends through the transverse aperture in the lever arm, the first transverse aperture in the tool head, and the second transverse aperture in the tool head. The pivot pin pivotally mounts the lever arm to the tool head with the cam end portion of the lever arm being positioned in the second slot so that the cam end of the lever arm cammingly contacts the downwardly facing cam face of the plunger. (See FIG. 2). Preferably, the pivot portion of the lever arm defines a bend so that the cam end portion of the lever arm extends from the longitudinal axis of the plunger at an angle $\alpha$ which is in the range of +/−30 degrees. See FIG. 2.

The handle portion of the frame has a longitudinal axis and preferably extends from the head at an angle $\beta$ between about 15 degrees and about 60 degrees as measured from the longitudinal axis of the borehole, more preferably at an angle in the range of 25 degrees to 45 degrees.

The handle portion of the lever arm has a longitudinal axis and the lever arm is preferably mounted to the tool head for pivotal motion over an angle $\gamma$ in the range of from about zero degrees to about 30 degrees with respect to the longitudinal axis of the handle portion of the frame. (See FIG. 1.)

Further preferred, the pivot portion of the lever arm is bent at an angle $\delta$ in the range of about 30 degrees to about 60 degrees. (See FIG. 3). Also in the preferred embodiment, the lever arm is formed from bar stock and the cam end 48 of the lever arm is rounded (See FIG. 3) and is received by the transverse slot in the plunger (See FIG. 2).

The handle portion of the frame preferably defines a trough 62 (See FIG. 4) for receiving the handle portion of the lever arm. (See FIG. 2)

A spring 64 is provided in the preferred embodiment which contacts the frame and the lever arm to bias the handle portion of the lever arm away from the handle portion of the frame. The spring 64 is preferably located by the pivot pin 60.

The first end of the plunger preferably defines a blade 66 suitable for forming a hole in a flat stock. The blade is sized so as to be received by the second borehole in the upper jaw. The blade is preferably formed by a beveled surface extending from the first end of the plunger 17. The beveled surface preferably faces generally toward the second lateral surface of the tool head.

Preferably, the plunger 8 has a generally cylindrical body portion 76 which extends from the first end of the plunger and is received by the first borehole and a generally cylindrical punch portion 78 which extends downwardly from the blade at the first end of the plunger. The generally cylindrical punch portion of the plunger has a smaller diameter than the generally cylindrical body portion of the plunger.

The plunger preferably further defines a downwardly facing surface 68 positioned between the first end and the second end of the plunger and an upwardly facing surface 70 positioned between the downwardly facing surface and the first end of the plunger, a transverse slot 71 being defined between the upwardly facing surface and the downwardly facing surface. The cam surface 46 in this embodiment is defined by the downwardly facing surface 68.

In a preferred embodiment of the invention, a stock stop plate 72 is adjustably mounted in the first slot (See FIG. 2) to regulate a depth of the first slot as measured from the first lateral surface toward the second lateral surface. In the illustrated embodiment, the stop plate is mounted to the tool head by a screw 74. See FIG. 1.

Figure 1:
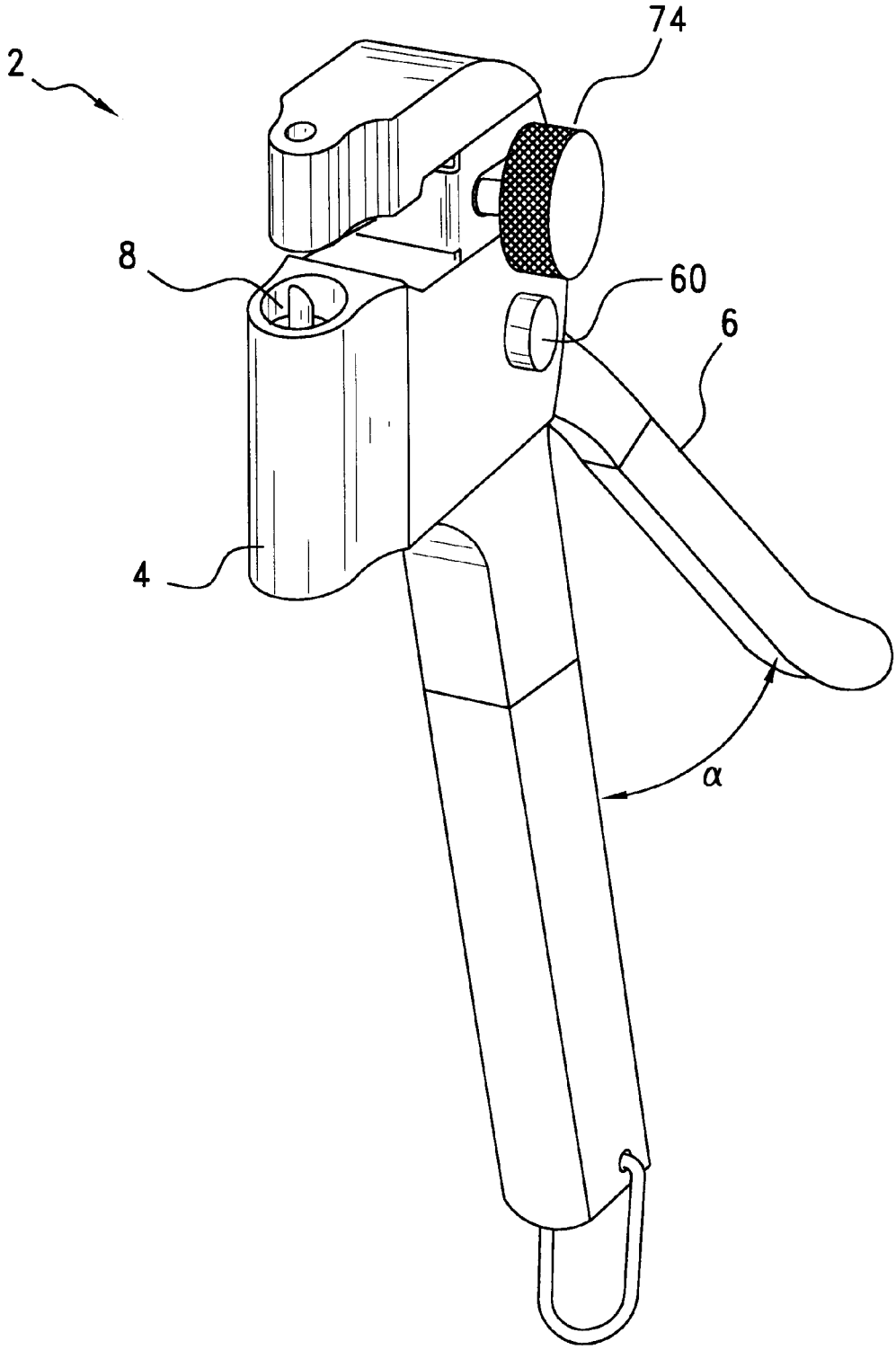
FIG. 1 is a pictorial representation of a tool according to one embodiment of the present invention.

In a further preferred embodiment, a latch loop 76 is mounted to at least one of the handle and the lever arm for selectively restraining the handle and the lever arm in a compact configuration. Preferably the loop is mounted to the handle as shown in FIG. 1.

While certain preferred embodiments of the invention have been described herein, the invention is not to be construed as being so limited, except to the extent that such limitations are found in the claims.

What is claimed is:

1. Apparatus comprising a frame which defines a tool head with a handle portion extending therefrom, said tool head having a front face and a back face, an upper end and a lower end, a first lateral side and a second lateral side, said tool head defining a lower jaw and an upper jaw spaced apart from the lower jaw to define a first slot opening into the tool head from the first lateral side between the upper jaw and the lower jaw, said lower jaw defining a first vertical borehole therethrough extending alongside the first lateral side, said first vertical borehole having a longitudinal axis and opening toward the upper jaw, said upper jaw defining a second vertical borehole therethrough extending alongside the first lateral side, said second vertical borehole having a longitudinal axis and opening toward the lower jaw and being in alignment with the first vertical borehole, said tool head further defining a second slot which is vertically elongated and forms a passage from the first vertical borehole to the second lateral side of the tool head, said tool head further defining a first transverse aperture which forms a passage extending from the front face of the tool head to the second slot and a second transverse aperture which forms a passage extending from the back face of the tool head to the second slot, said second transverse aperture being in alignment with the first transverse aperture, wherein the handle portion extends from the lower end of the tool head, a plunger having a longitudinal axis, a first end and a second end slidably mounted in the first vertical borehole, said plunger having a downwardly facing cam face between its first end and its second end, and wherein the second end of the plunger defines a blade suitable for forming a hole in a flat stock, said blade being sized so as to be received by the second borehole in the upper jaw a lever arm having a cam end, a cam end portion extending from the cam end, a handle end, a handle end portion extending from the handle end, and a pivot portion which connects the cam end portion and the handle and portion and defines a transverse aperture for receiving a pivot pin, and a pivot pin which extends through the transverse aperture in the lever arm, the first transverse aperture in the tool head, and the second transverse aperture in the tool head, to pivotally mount the lever arm to the tool head with the cam end portion of the lever arm being positioned in the second slot so that the cam end of the lever arm cammingly contacts the downwardly facing cam face of the plunger, wherein the handle portion of the frame has a longitudinal axis and extends from the head at an angle between about 15 degrees and about 60 degrees as measured from the longitudinal axis of the borehole, and the pivot portion of the lever arm defines a bend in the range of from about 30 degrees to about 60 degrees so that the cam end portion of the lever arm extends from the longitudinal axis of the plunger at an angle in the range of which is in the range of from about zero degrees to about 30 degrees, and the lever arm is mounted to the tool head for pivotal motion over an angle in the range of from about zero degrees to about 45 degrees with respect to the longitudinal axis of the handle portion of the frame.

2. Apparatus as in claim 1 wherein the handle portion of the frame defines a trough for receiving the handle portion of the lever arm.

3. Apparatus as in claim 2 further comprising a spring which contacts the frame and the lever arm to bias the handle end portion of the lever arm away from the handle portion of the frame.

4. Apparatus as in claim 3 wherein the spring is located by the pivot pin.

5. Apparatus as in claim 4 further comprising a stock stop plate adjustably mounted in the first slot to regulate a depth of the first slot as measured from the first lateral surface toward the second lateral surface.

6. Apparatus as in claim 5 wherein the plunger defines a downwardly facing surface positioned between the first end and the second end of the plunger and an upwardly facing surface positioned between the downwardly facing surface and the first end of the plunger, a transverse slot being defined between the upwardly facing surface and the downwardly facing surface, and the cam surface is defined by the downwardly facing surface.

7. Apparatus as in claim 6 wherein the lever arm is formed from bar stock and the cam end of the lever arm is rounded and is received by the transverse slot in the plunger.

8. Apparatus as in claim 7 wherein the handle portion of the frame extends from the head at an angle between about 25 degrees and about 45 degrees as measured from the longitudinal axis of the borehole.

9. Apparatus as in claim 5 wherein the plunger has a generally cylindrical body portion which extends from the first end of the plunger and is received by the first borehole and a generally cylindrical punch portion which extends downwardly from the blade at the first end of the plunger.

10. Apparatus as in claim 9 wherein the generally cylindrical punch portion of the plunger has a smaller diameter than the generally cylindrical body portion of the plunger.

11. Apparatus as in claim 10 wherein the blade is formed by a beveled surface extending from the first end of the plunger.

12. Apparatus as in claim 11 wherein the beveled surface faces generally toward the second lateral surface of the tool head.

13. Apparatus as in claim 12 further comprising a latch loop mounted to at least one of the handle portion of the frame and the handle end portion of the lever arm for selectively restraining the handle portion of the frame and the handle end portion of the lever arm in a compact configuration.

* * * * *